United States Patent [19]

Rehmann

[11] Patent Number: 4,637,311

[45] Date of Patent: Jan. 20, 1987

[54] METHOD OF, AND APPARATUS FOR, INCREASING THE ENERGY IN AN ELECTROMAGNETIC FUZE SYSTEM

[75] Inventor: Robert Rehmann, Neerach, Switzerland

[73] Assignee: EMS-Inventa AG, Zurich, Switzerland

[21] Appl. No.: 700,612

[22] Filed: Feb. 11, 1985

[30] Foreign Application Priority Data

Feb. 24, 1984 [CH] Switzerland ..... 919/84

[51] Int. Cl.[4] ..... F42C 11/02

[52] U.S. Cl. ..... 102/209

[58] Field of Search ..... 102/209

[56] References Cited

U.S. PATENT DOCUMENTS

| | | | |
|---|---|---|---|
| 3,035,520 | 5/1962 | Koeppen | 102/209 |
| 3,119,335 | 1/1964 | Wyser | 102/209 |
| 3,207,075 | 9/1965 | Semenoff | 102/262 |
| 3,994,228 | 11/1976 | Hurlimann | 102/209 |
| 4,088,076 | 5/1978 | Karayannis | 102/209 |

FOREIGN PATENT DOCUMENTS

| | | | |
|---|---|---|---|
| 1140842 | 12/1962 | Fed. Rep. of Germany . | |
| 1140843 | 12/1962 | Fed. Rep. of Germany . | |
| 1936878 | 2/1970 | Fed. Rep. of Germany | 102/209 |
| 1251730 | 4/1967 | France . | |
| 356045 | 9/1961 | Switzerland . | |
| 1261097 | 1/1972 | United Kingdom . | |

*Primary Examiner*—Charles T. Jordan

*Attorney, Agent, or Firm*—Werner W. Kleeman

[57] ABSTRACT

In the method of increasing the detonation energy in an electromagnetic fuze system of a low-acceleration projectile a detonator generator which is held in an inactive or rest position by an elastic force, is accelerated along a predetermined travel path in the rear portion of a housing at the onset of the firing acceleration. The detonator generator is accelerated such that the detonator generator impacts upon an impact body which is provided with a central bore. As a result, a reaction member of the detonator generator inactivates its mechanical safety device and is accelerated, thus providing the detonation energy. In the retarding phase the detonator generator is returned into its original position by means of the elastic force and thus is ready for detonation. In comparison to known methods and apparatus there can thus be dispensed with an external power supply, whereby safety is increased with respect to maintenance, tests and firing.

16 Claims, 6 Drawing Figures

METHOD OF, AND APPARATUS FOR, INCREASING THE ENERGY IN AN ELECTROMAGNETIC FUZE SYSTEM

BACKGROUND OF THE INVENTION

The present invention relates to a new and improved method of, and apparatus for, generating increased energy in an electromagnetic fuze system of a low-acceleration projectile, meaning not only low-acceleration projectiles as such but also, for instance, rockets or missiles.

In its more particular aspects, the present invention relates specifically to an improved method of, and apparatus for, generating increased energy in an electromagnetic fuze system of a low-acceleration projectile, as such term is hereinbefore defined, and in such electromagnetic fuze system a detonator or ignition generator is provided with a reaction member which is mechanically disarmed in its inactive or rest position and which is displaceable relative to an associated stator under the action of the firing acceleration. The thus generated electrical energy is stored in a capacitor and is made available for the detonation of an electric primer capsule.

There are already known fuze systems for projectiles and such fuze systems comprise a generator. During acceleration a reaction member is displaced through a coil, the inductive effect of which is increased by an iron core, in order to provide the required detonation energy by means of a capacitor. In an arrangement as known, for example, from Swiss Pat. No. 356,045 a permanent magnet is displaceably arranged within a coil surrounded by a magnet. The magnet is mounted in its inactive or rest position in a recess or cut-out of an insulator by means of a contact pin. During firing of the associated projectile the pin is released due to the acceleration, the magnet moves through the magnetic field of the coil and charges a capacitor which stores the detonation energy until impact of the projectile at the target.

Such systems operate in a satisfactory manner at high firing accelerations which enable an unlocking or arming operation to be accomplished for the projectile, however, such systems fail at relatively low accelerations.

SUMMARY OF THE INVENTION

Therefore, with the foregoing in mind, it is a primary object of the present invention to provide a new and improved method of, and apparatus for, generating increased energy in an electromagnetic fuze system of a low-acceleration projectile and by means of which sufficiently high detonation energy is provided.

Another and more specific object of the present invention is directed to the provision of a new and improved method of, and apparatus for, generating increased energy in an electromagnetic fuze system of a low-acceleration projectile and by means of which a fuze system is provided which insures a high degree of safety during handling as well as during firing of the projectile.

Now in order to implement these and still further objects of the invention, which will become more readily apparent as the description proceeds, the method of the present development is manifested by the features that the detonation generator is held in a first position at its front side in a bore by means of an elastic force at the moment of firing. After the onset of the firing acceleration the detonator generator is coaxially displaced into a second position due to its inertial forces, whereby the detonator generator impacts at an impact body or anvil which is provided with a central bore and located within a rear portion of a housing. In this second position a mechanical safety or disarming device of a reaction member of the detonator generator is rendered ineffective and the reaction member is accelerated, whereby electrical energy is produced. The detonator generator is returned into its first position by means of the elastic force and in this first position the electrical energy is provided and transmitted to a mechanically and/or electrically disarmed fuze system.

It is one of the advantages of the inventive method that after the onset of the firing acceleration the energy which is required for detonating the electric detonator is directly generated during firing, namely by the detonator generator itself. This detonator generator is accelerated along a predetermined travel path for a predetermined time interval and thrust against the impact body or anvil which is provided with a bore. During the impact at the impact body or anvil the reaction member of the detonator generator produces a voltage pulse by means of which a capacitor is charged and which is present within the detonator generator. At the end of the acceleration phase the detonator generator is thrust back into its original position by means of the elastic force and transmits its energy, in cooperation with further safety elements, at the correct moment of time for detonation.

Advantageously, the detonator generator is displaced conjointly with a fuze element which is in a mechanically and/or electrically disarmed or safety condition, within the housing of the electromagnetic fuze system by means of inertial forces and is displaced in the reverse direction by means of the force of a compression spring. The advantage of this further development resides in the fact that the mass which moves relative to the housing is substantially increased, so that a greater energy affecting the movable members is available.

Preferably, the detonator generator is axially guided in a bore and during its movements between the first and second positions is guided along a predetermined limited travel path for a predetermined time interval.

Advantageously, the detonator generator is held by means of an elastic force in the first position which is located at the side of the target and the associated compression spring generating this elastic force is selected such that the detonator generator is brought into its second position within at least 3 milliseconds by means of a firing acceleration in the range of about 100 to about 300 g.

As alluded to above, the invention is not only concerned with the aforementioned method aspects, but also relates to a novel construction of apparatus for the performance thereof. Generally speaking, the inventive apparatus comprises a detonator or ignition generator provided with a reaction member which is mechanically disarmed in its inactive or rest position and which is displaceable relative to an associated stator under the action of the firing acceleration. The resulting electrical energy is stored in a capacitor and made available for detonating an electric primer capsule.

To achieve the aforementioned measures, the inventive apparatus for generating increased energy in an electromagnetic fuze system of a low-acceleration projectile, in its more specific aspects, comprises:

a compression spring located in a housing and mounting the detonator generator in a first position;

a contact pin provided in the detonator generator and telescopingly displaceable in a contact sleeve;

a rotor which is located in a housing and supports the electric primer capsule and which can be rotated from a disarmed or safety position into an active or armed position; and the detonator generator, in the first position thereof, being electrically connected to the rotor when the latter assumes the armed position.

Such apparatus is particularly favorable in terms of safety aspects. The apparatus prevents premature detonation during firing of the projectile because the electrical connection leading to the support of the electric primer capsule is interrupted by "lifting off" the contact pin already at low-firing acceleration.

Advantageously, the detonator generator is longitudinally displaceably arranged in a threaded first or lower housing member or housing and the disarmed fuze element is fixedly mounted in a second or upper housing member or housing.

According to another modification of the inventive apparatus the detonator generator is mounted within insulating sleeves conjointly with the disarmed fuze element, and these insulating sleeves are longitudinally slideably mounted in a housing, preferably constituted by a one-piece housing. This variant represents a constructional simplification. The movable mass intended to initiate the detonation in this particular apparatus is greater as concerns the technically required components.

Preferably, peripheral recesses are provided in the cylindrical bore of the first or lower housing member. Such peripheral recesses serve to reduce the friction of the detonator generator at the wall of the lower housing member during its acceleration and prevent jamming of the detonator generator in the bore of such lower housing member.

According to a preferred embodiment of the inventive apparatus the recesses are symmetrically arranged. Four symmetrically arranged recesses have proven particularly favorable. The detonator generator is able to slide at the remaining surfaces of the bore practically free of friction. The air which is present in the bore can be displaced without any difficulties.

Advantageously, an impact body is mounted in the rear portion of the housing, for instance the lower portion of the first or lower housing member and serves as an anvil. This impact body or anvil is made of an aluminum alloy.

Advantageously, the impact body is wedged or flanged over a compressible body with which it snugly engages. Particularly suitable are compressible bodies made of lead, aluminum, zinc and other appropriate compressible materials.

Preferably, a central bore is provided in the impact body and serves to provide contactless accommodation of a tip or tip portion of the reaction member. The central bore comprises a conical opening which permits reliable penetration of the tip of the reaction member even with larger tolerances for the axial guidance of the reaction member.

Preferably, the housing or its component housing parts, as the case may be, are manufactured of an aluminum alloy. Such aluminum alloys possess low density and can be economically processed to yield a threadable fuze housing.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
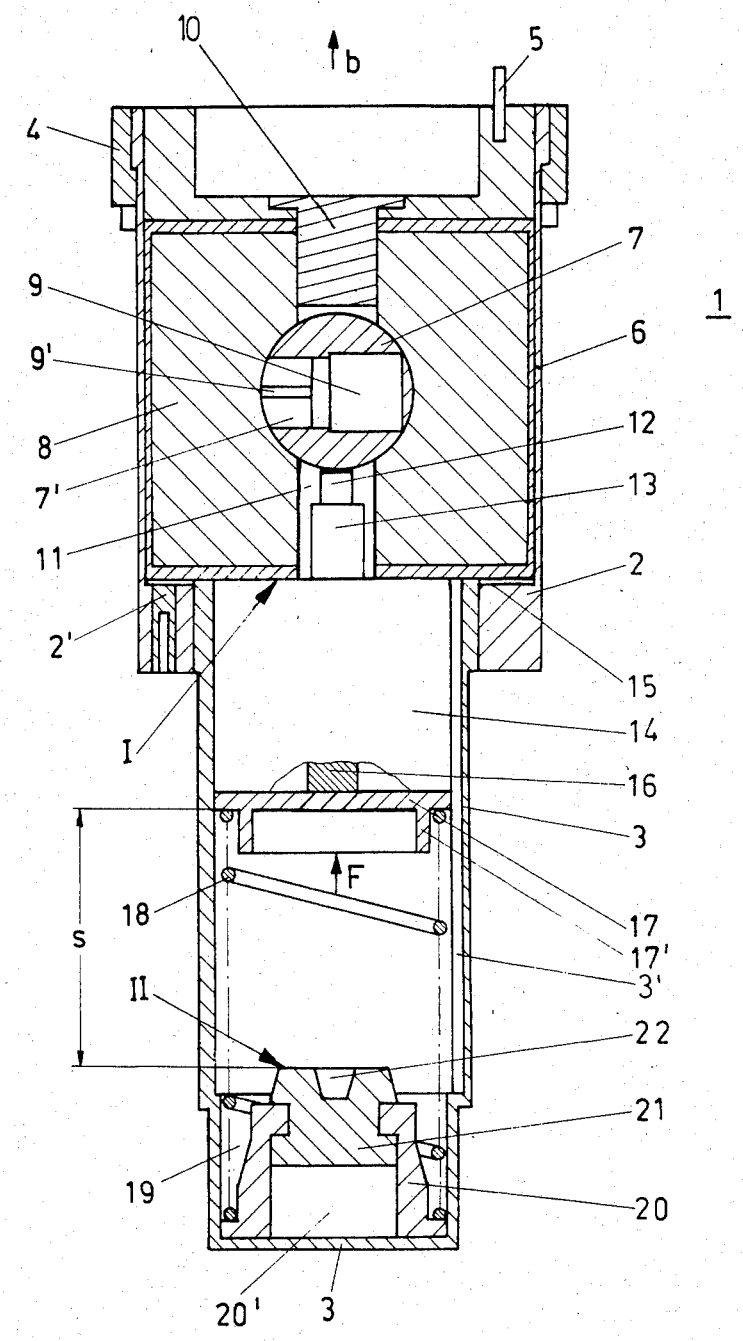
FIG. 1 is a longitudinal section through a first embodiment of the inventive apparatus showing the electromagnetic fuze system in the disarmed or safety condition.

Describing now the drawings, it is to be understood that only enough of the construction of the apparatus has been shown as needed for those skilled in the art to readily understand the underlying principles and concepts of the present development, while simplifying the showing of the drawings. Turning attention now specifically to FIG. 1, there has been illustrated in longitudinal section a first exemplary embodiment of the inventive apparatus for generating increased energy in an electromagnetic fuze system of a low-acceleration projectile. The electromagnetic fuze system is generally designated by reference numeral 1 in FIG. 1. A first or lower housing member 3 is threadably connected to a second or upper housing member 2, with the housing members 2 and 3 defining a two-part housing structure or housing. This second or upper housing member 2 is provided with at least one mounting member 2'. The first or lower housing member 3 has a smaller diameter than the second or upper housing member 2. This second or upper housing member 2 of the electromagnetic fuze system 1 carries a threaded ring 4 and a cylindrical pin 5.

In the interior of the second or upper housing member 2 a rotor 7 is installed in an insulating sleeve 6 of a fuze element 8. The rotor 7 comprises a bore 7' and contains an electric primer capsule 9 which is provided with a pole pin 9'. In the disarmed or safety condition the electric primer capsule 9 is transversely positioned with respect to the detonating or ignition chain. Two barriers or blocking devices prevent the rotor 7 from premature rotation and completion of the detonating or ignition chain and since they are of conventional design such blocking devices therefore have not been particularly illustrated. A threaded bore 10 is provided for accommodating a booster-detonator.

A further bore 11 is provided in the fuze element 8 and serves for centering a telescoping contact pin 12 which is arranged in a contact sleeve 13 of a detonator generator 14. A conductive contacting surface 15 is provided between the detonator generator 14 and the insulating sleeve 6. By means of the front elevation shown in FIG. 1 there is depicted a reaction member 16 of the detonator generator 14 and this reaction member 16 constitutes the lower one of two pole pieces or pole shoes. A disk or plate 17 is held by means of a compression spring 18 which is fixed by means of a retainer 17'. The compression spring 18 is wedged into a recess or cut-out 19 formed between a compressible body 20 and the cylindrical wall of the first or lower housing member 3. The compressible body 20 comprises a void or empty space 20' and is made of lead. This compressible body 20 serves for mounting an impact body or anvil 21 which comprises a wedge-shaped central bore 22.

Figure 2:
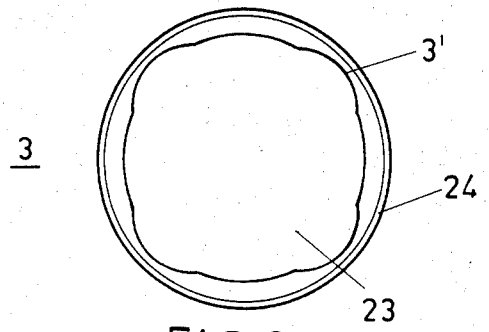
FIG. 2 is a top plan view of the opening of a lower housing member of the two-part housing of the apparatus shown in FIG. 1.

FIG. 2 is a top plan view and shows the bore 23 of the first or lower housing member 3. The outer margin of the bore 23 is formed by a thread 24. Peripheral recesses 3' are provided at the inner surface of the bore 23. FIG. 2 shows four such peripheral recesses 3'.

Figure 3:
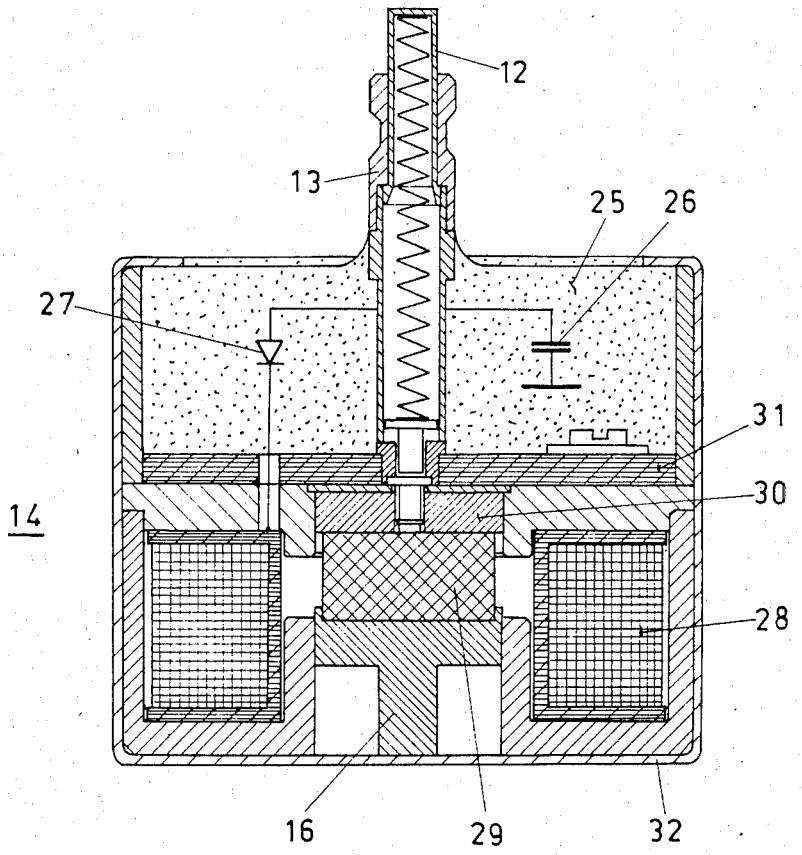
FIG. 3 is an enlarged section through a detonator generator of the apparatus shown in FIG. 1.

FIG. 3 shows the detonator generator 14 in an enlarged scale, and with reference thereto there will now be described the components thereof which are essential for the inventive apparatus. In its top portion the detonator generator 14 contains a dielectric 25 which, for example, is made of a cured epoxy resin (Araldite available from the well known company Ciba Geigy Limited, Switzerland). A capacitor 26 and a diode 27 are imbedded in the dielectric 25. In the base portion of the detonator generator 14 there is located a coil 28, defining a stator, and which surrounds a magnet core 29 between the reaction member 16 which constitutes a lower pole piece or pole shoe and a member 30 which constitutes an upper pole piece or pole shoe. The top portion and the base portion of the detonator generator 14 are separated from each other by means of a blocking spring 31. The detonator generator 14 is enclosed in a casing 32 from which there protrudes the contact pin 12.

Figure 4:
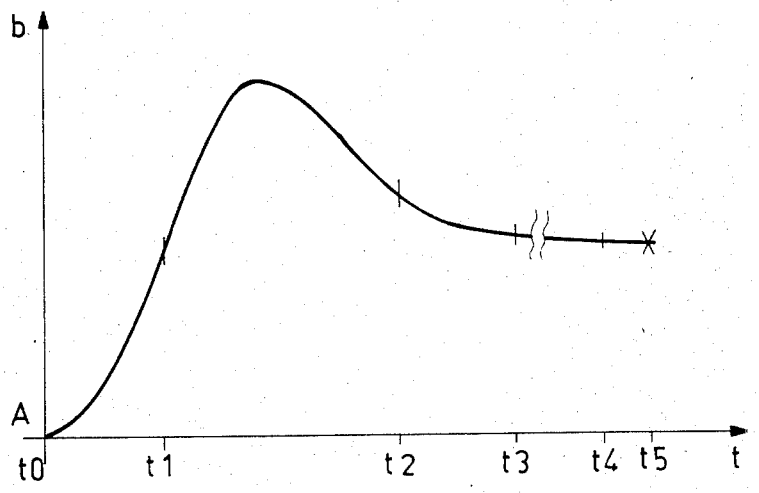
FIG. 4 is a graph which plots the characteristic acceleration as a function of time of a projectile accelerated by propulsion engines.

FIG. 4 shows a characteristic course of an acceleration curve for a projectile. Therein the variation of the acceleration b is shown as a function of time t. At a moment of time $t_0$ prior to projectile firing, the detonator generator 14 of the inventive electromagnetic fuze system is in its first inactive or rest position. After the onset of the firing acceleration b and at the moment of time $t_1$ the detonator generator 14 of the electromagnetic fuze system is displaced into its second position. During such displacement the tip portion or end of the reaction member 16 enters the central bore 22 of the impact body 21 located at the rear end of the first or lower housing member 3 and impacts against such impact body or anvil 21. During such displacement the detonator generator 14 is accelerated and slides along the edges of the recesses 3' with a minimum of friction. The air present in the first or lower housing member 3 is not compressed since such air can escape sufficiently rapidly through the passages formed by the recesses 3'. During the retardation phase the detonator generator 14 is returned into its first position by means of the compression spring 18 and arrives at this first position at the moment of time $t_2$. At the moment of time $t_3$ the acceleration b is constant, at the moment of time $t_4$ the fuze is activated or armed and the detonation occurs at the moment of time $t_5$. The detonation occurs when the target is hit, whereby the double cap or dome of the projectile is crushed and thus closes the electric detonation circuit.

Figure 5:
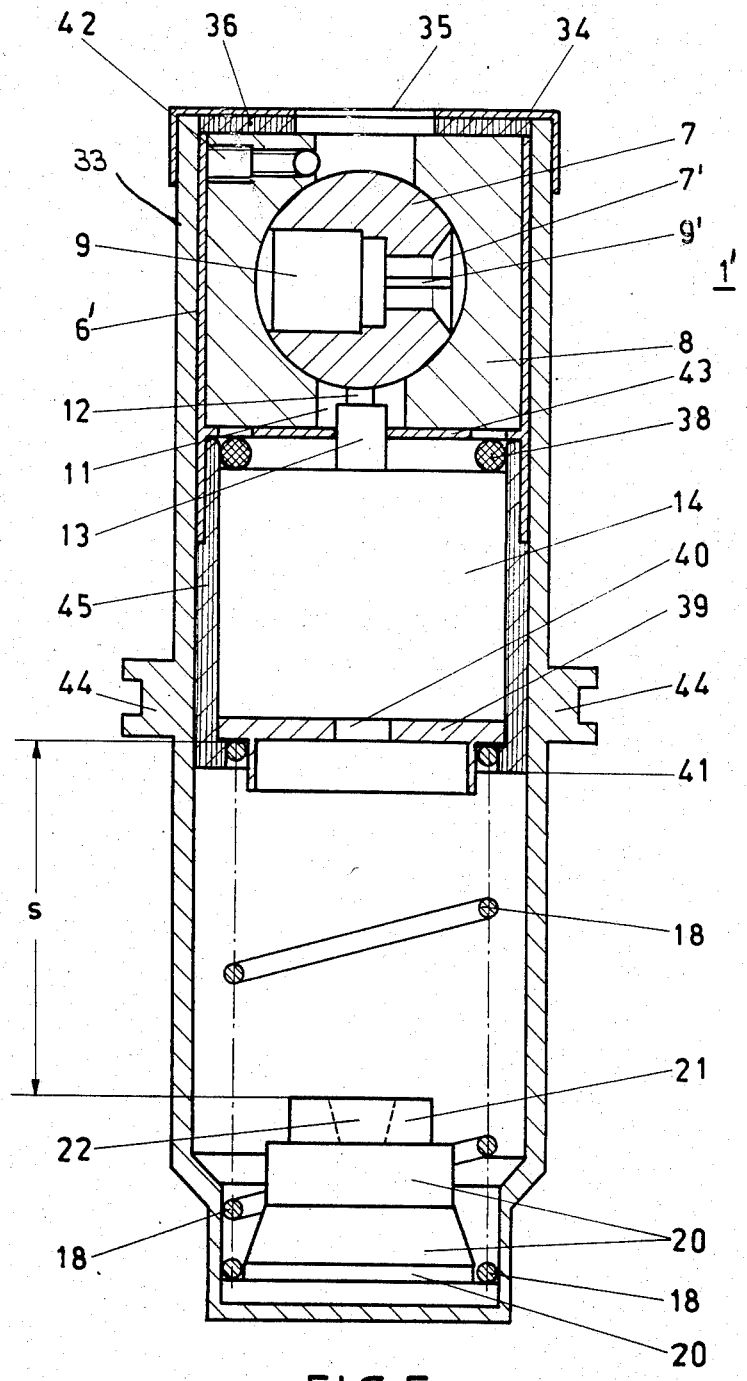
FIG. 5 is a longitudinal section through a second embodiment of the apparatus according to the invention in the disarmed or safety condition.
Figure 6:
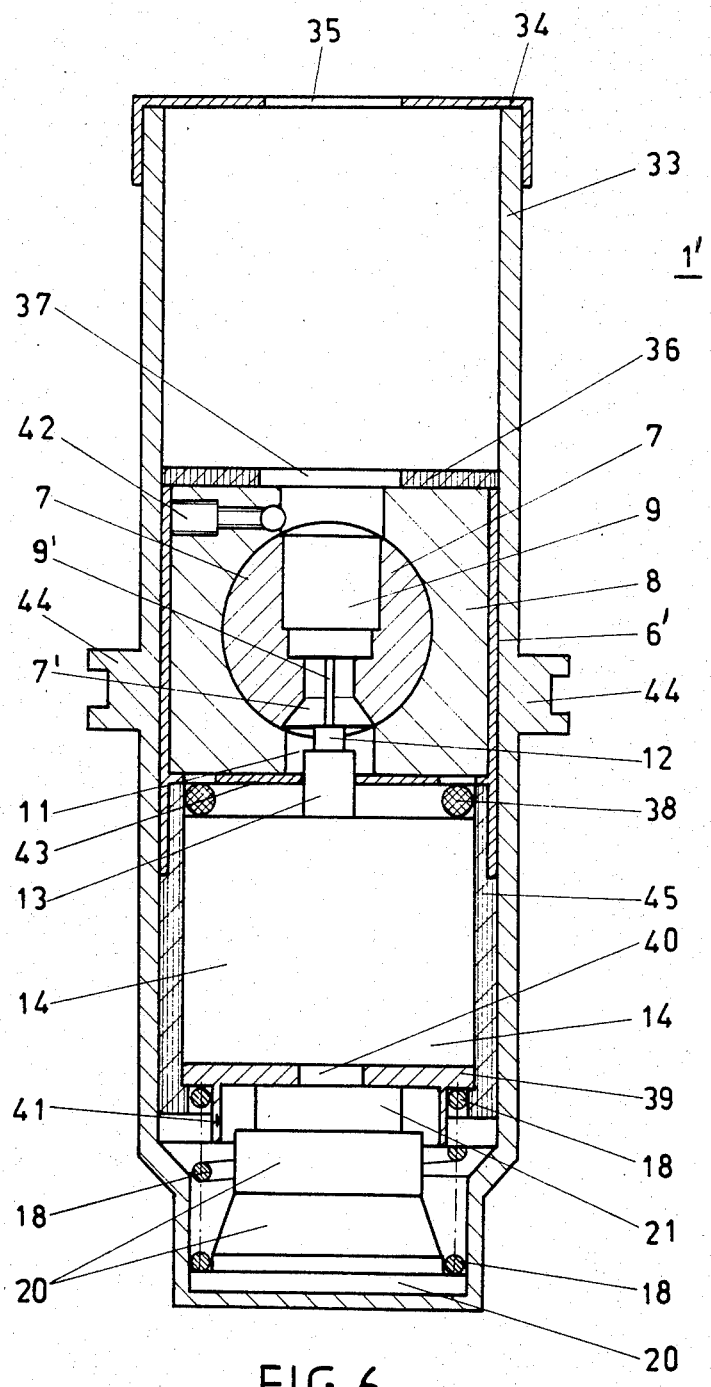
FIG. 6 is a longitudinal section through the apparatus shown in FIG. 5 during firing of the projectile.

An exemplary second embodiment of the apparatus according to the invention is illustrated by FIGS. 5 and 6 in a longitudinally sectional view. The apparatus shown in FIG. 5 is in the disarmed or safety condition and FIG. 6 shows the state of the apparatus during projectile firing. In this second embodiment of the inventive apparatus an integrally formed or one-piece housing 33 is provided with a cover 34. This cover 34 comprises an opening 35. The fuze element 8 is provided with a first insulating disk or plate 36 comprising an opening 37. An O-ring 38 is located below the fuze element 8. This O-ring 38 spaces the fuze element 8 from the detonator or ignition generator 14. A disk or plate 39 provided with an opening 40 is arranged below the detonator generator 14. This disk or plate 39 serves as an upper or top support for the compression spring 18 and corresponds to the disk or plate 17 in the first embodiment of the inventive apparatus shown in FIG. 1. The upper position of the compression spring 18 is insured by means of an annularly shaped retainer 41.

An electric primer capsule 9 containing a pole pin 9' is arranged in a rotor 7 mounted in the fuze element 8. The pole pin 9' is located witin a bore 7' of the rotor 7. A blocking pin 42 extends into the region of the rotor 7. On its lower or bottom side the fuze element 8 is provided with a second insulating disk or plate 43.

The integrally formed or one-piece housing 33 comprises a mounting flange 44. The detonator generator 14 is placed in a second or lower insulating sleeve 45 which is fixedly connected to a first or upper insulating sleeve 6' such that the fuze element 8 and the detonator generator 14 form an integral unit. As already described with reference to the first exemplary embodiment, an impact body or anvil 21 which is mounted at a compressible body 20, is also contained in the second exemplary embodiment of the inventive apparatus.

The mode of operation of the apparatus illustrated by FIGS. 5 and 6 is the same as in the first exemplary embodiment described hereinbefore with reference to FIGS. 1 to 4. The difference between the two embodiments essentially is that in the second exemplary embodiment the fuze element 8 and the detonator generator 14 are interconnected by means of the first and second or upper and lower insulating sleeves 6 and 45. These components thus form an integral unit and are conjointly displaceable within the integrally formed, one-piece housing 33. As already pointed out hereinbefore, there is thus obtained a greater moveable mass which additionally increases the functional reliability of the inventive apparatus.

The inventive apparatus containing the electromagnetic fuze system described hereinbefore is specifically designed for low accelerations such as occur in rocket-propelled projectiles.

In case the electrical detonation circuit remains interrupted for one reason or another, the capacitor 26 of the detonator generator 14 is discharged during a time interval of about 10 minutes. There thus results a disarmed or de-energized dud projectile.

The inventive construction permits the provision of autonomous detonating systems which are functional independently of secondary or external power supplies such as batteries and so forth. The generated electrical energy is sufficient for supplying power to electrical safety devices, timers and proximity sensors in addition to reliably detonating so-called thin-layer electric primer capsules.

In comparison to hitherto known detonating methods and detonating apparatus used in rocket-propelled projectiles, the inventive method and apparatus further permit extensive simplifications in testing and servicing such weapons. The safety of the maintenance and operating personnel is thereby increased to a high degree because due to the inventive system maintenance and/or testing operations can be performed at any time and independent of the current supply to the remaining system, i.e. to the electronic control and other components.

While there are shown and described present preferred embodiments of the invention, it is to be distinctly understood that the invention is not limited thereto, but may be otherwise variously embodied and practiced within the scope of the following claims.

According, what I claim is:

1. A method of generating increased energy in an electromagnetic fuze system of a low-acceleration projectile, said electromagnetic fuze system containing a detonator generator operatively connectable to a fuze element and provided with a reaction member which is displaceable from a rest position with respect to an associated stator under the action of a firing acceleration, the electrical energy produced thereby being storable in a capacitor and being provided thereby for detonating an electric primer capsule located in said fuze element, said method comprising the steps of:

arranging the detonator generator in a first position in a housing of the electromagnetic fuze system;

arranging an impact body in a rear portion of said housing in spaced relationship and opposite to said detonator generator when in said first position;

holding said detonator generator in said first position thereof in a bore of said housing by means of an elastic force acting upon a front side of said detonator generator at the moment of firing said projectile;

after the onset of the firing acceleration, displacing said detonator generator from said first position thereof and coaxially relative to said housing into a second position due to inertial forces acting upon said detonator generator;

impacting said detonator generator in the second position thereof against said impact body provided with a central bore and thereby accelerating said reaction member in order to generate electrical energy;

thereafter returning said detonator generator from said second position into said first position thereof by means of said elastic force; and transmitting said electrical energy, after said detonator generator has arrived at its first position, to the fuze element.

2. The method as defined in claim 1, wherein:

said step of impacting said detonator generator and thereby accelerating said reaction member includes the step of releasing a safety device maintaining said reaction member in a disarmed condition.

3. The method as defined in claim 1, further including the steps of:

interconnecting said fuze element in a disarmed condition thereof and said detonator generator with one another;

said step of coaxially displacing said detonator generator after the onset of said firing acceleration entails the step of displacing said fuze element conjointly with said detonator generator in said housing; and said step of returning said detonator generator into said first position thereof entails the step of returning said fuze element conjointly with said detonator generator.

4. The method as defined in claim 1, further including the step of:

axially guiding said detonator generator while displacing the same between said first and said second positions thereof and while the same is located in said first position and said second position, in the bore of said housing and along a predetermined limited travel path within a predetermined time interval.

5. The method as defined in claim 1, further including the steps of:

generating said elastic force for holding said detonator generator in its first position which constitutes a position on the side of a target of the projectile, by means of a compression spring; and selecting the force of said compression spring such that said detonator generator is brought into its second position during a time interval of at least 3 milliseconds under the action of a firing acceleration in the range of about 100 to about 300 g.

6. A method of generating increased energy in an electromagnetic fuze system of a low-acceleration projectile, said method comprising the steps of:

providing a fuze element in a disarmed condition;

arranging, in a state of rest of said projectile, a detonator generator in a first position situated close to said fuze element;

after firing the projectile and the onset of the firing acceleration of the fired projectile, arming said fuze element and displacing said detonator generator from said first position to a second position situated remote from said fuze element;

impacting said detonator generator in said second position thereof against an impact body and thereby generating electrical energy;

storing said electrical energy in said detonator generator;

during a retardation phase of the projectile travel, returning said detonator generator from said second position thereof to said first position situated closer to said fuze element; and transmitting, after returning said detonator generator into its first position, the electrical energy stored in said detonator generator to said armed fuze element.

7. An apparatus for generating increased energy in an electromagnetic fuze system of a low-acceleration projectile, said apparatus comprising:

a housing provided with a bore;

a detonator generator arranged in said bore of said housing;

a compression spring;

said compression spring holding said detonator generator in a first position thereof in said bore of said housing;

a contact pin and a contact sleeve provided at said detonator generator;

said contact pin being telescopingly displaceable in said contact sleeve;

an impact body provided in said housing and against which impacts said detonator generator when assuming a second position for generating electrical energy;

a fuze element located in said housing;

said detonator generator in said first position thereof being operatively connectable to said fuze element;

said fuze element comprising:

a rotor rotatable from a disarmed into an armed position;

an electric primer capsule carried by said rotor; and said detonator generator being electrically connected to said rotor when said detonator generator in its first position is operatively connected to said fuze element in its armed position.

8. The apparatus as defined in claim 7, wherein:

said housing comprising a first housing member and a second housing member;

said first housing member is provided with a threaded portion;

said detonator generator being longitudinally displaceably arranged in said first housing member;

said fuze element being fixedly mounted in its disarmed condition in said second housing member; and said second housing member being arranged at the top of said first housing member.

9. The apparatus as defined in claim 7, further including:

insulating sleeves;

said detonator generator being mounted in said insulating sleeves conjointly with said fuze element in the disarmed condition of said fuze element;

said housing defining a one-piece housing and having a longitudinal direction; and said insulating sleeves being longitudinally slidably mounted in said one-piece housing.

10. The apparatus as defined in claim 7, further including:

a compressible body provided in said housing; and said impact body being fitted to said compressible body.

11. The apparatus as defined in claim 7, wherein:

said impact body is provided with a central bore.

12. The apparatus as defined in claim 8, wherein:

said first housing member and said second housing member are each made of an aluminum alloy.

13. The apparatus as defined in claim 7, wherein:

said housing comprises two opposed ends;

one of said two opposed ends being situated closer to said fuze element than the other one of said two opposed ends;

said detonator generator in its first position being located at said one of the two opposed ends which is situated closer to said fuze element; and said detonator generator in its second position being located at said other one of said two opposed ends which is more remote from said fuze element.

14. The apparatus as defined in claim 7, wherein:

said housing is made of an aluminum alloy.

15. An apparatus for generating increased energy in an elecromagnetic fuze system of a low-acceleration projectile, said apparatus comprising:

a housing provided with a bore;

a detonator generator arranged in said bore of said housing;

a compression spring;

said compression spring holding said detonator generator in a first position thereof in said bore of said housing;

a contact pin and a contact sleeve provided at said detonator generator;

said contact pin being telescopingly displaceable in said contact sleeve;

an impact body provided in said housing and against which impacts said detonator generator when assuming a second position for generating electrical energy;

a fuze element located in said housing;

said detonator generator in said first position thereof being operatively connectable to said fuze element;

at least two peripheral recesses provided in said bore of said housing; and said bore in said housing constituting a substantially cylindrical bore.

16. The apparatus as defined in claim 15, wherein:

said at least two peripheral recesses are symmetrically arranged relative to said substantially cylindrical bore.

* * * * *